United States Patent [19]

Reiling et al.

[11] Patent Number: 4,890,422

[45] Date of Patent: Jan. 2, 1990

[54] ABRASIVE TOOL

[76] Inventors: Reinhold Reiling; Karl Reiling, both of Remchinger Str. 4, D-7537 Koenigsbach-Stein, Fed. Rep. of Germany

[21] Appl. No.: 200,611

[22] Filed: May 31, 1988

[30] Foreign Application Priority Data

Dec. 10, 1987 [DE] Fed. Rep. of Germany ... 8716321[U]

[51] Int. Cl.[4] ..... B24B 45/00

[52] U.S. Cl. ..... 51/168; 51/358; 51/378; 15/144 A; 464/51; 464/106; 464/185

[58] Field of Search ..... 51/168, 209 R, 358, 51/376, 378, 389; 15/144 A; 403/148, 229; 464/51, 58, 97, 106, 182, 185

[56] References Cited

U.S. PATENT DOCUMENTS

| | | | |
|---|---|---|---|
| 2,531,775 | 11/1950 | Kenerson | 51/378 |
| 2,854,829 | 10/1958 | Porter | 51/209 R X |
| 2,918,760 | 12/1959 | Lilleberg | 51/168 |
| 3,707,059 | 12/1972 | Bartch et al. | 51/358 |
| 4,674,234 | 6/1987 | Reiling et al. | 51/168 |
| 4,760,670 | 8/1988 | MacKay, Jr. | 51/378 X |

*Primary Examiner*—Robert P. Olszewski
*Attorney, Agent, or Firm*—Balogh, Osann, Kramer, Dvorak, Genova & Traub

[57] ABSTRACT

This invention relates to an abrasive tool for grinding and polishing. A disk, which may consist of an abrasive disk or may carry a buffing pad consisting of an abrasive-containing woven fabric, is connected to a shaft that is adapted to be gripped by a driving chuck of a hand-held drilling machine or a hobbyist's machine. The shaft comprises a flexible shaft section and the tool is provided with means for reliably stiffening the shaft even during an operation at high speed and under stong abrasive forces. Besides, the tool should be usable as a grinding tool having a smaller grinding surface. An end flange is screwed to a first rigid shaft section and is disposed on the front face of the disk. A bowl which has a smaller radius than the disk is disposed on the rear of the disk. A fixing member provided with said bowl comprises a core sleeve, which has internal screw threads, which interengage with first external screw threads on the first rigid shaft section so that the disk can be gripped between the end flange and the domed cover. The core sleeve surrounds the flexible shaft section, which is disposed between the first rigid shaft section and a second rigid shaft section, which is formed with second external screw threads, which interengage with a nut that is disposed on the rear side of the bowl and is adapted to be tightened against said bowl around the core sleeve for a transmission of torque from said second rigid shaft section via said nut and said bowl to said disk whereas said flexible shaft section is relieved from torque.

6 Claims, 2 Drawing Sheets

ABRASIVE TOOL

BACKGROUND OF THE INVENTION

1. Field of the Invention

This invention relates to an abrasive tool for grinding and polishing comprising a disk and, in one embodiment, a buffing pad which is attached to that disc and consists of an abrasive-containing woven fabric. The tool is provided with a shaft that is adapted to be gripped in a driving chuck, particularly in a handheld drilling machine or in a machine for use by hobbyists.

2. Description of the Prior Art

Published German Application 32 22 858 and German Patent Specification 34 39 230 and the corresponding U.S. Pat. No. 4,674,234 disclose such abrasive tools in which the shaft comprises a flexible shaft section, which consists of a length of wire rope or an elastomeric pad, and in which the disk is adapted to be detachably secured to the end of the shaft by means of an end flange of said shaft and interengaging external and internal screw threads provided on the shaft and a fixing member, respectively, which is adapted to be tightened against the disk so as to force the latter against the flange.

SUMMARY OF THE INVENTION

It is an object of the invention to permit a reliable stiffening of the shaft even during an operation of the abrasive tool at high speeds and with strong abrading forces and to permit also the use of an abrasive disk having a relatively small abrading surface.

In an abrasive tool which is of the kind described first hereinbefore and in which the shaft comprises a flexible shaft section, which consists of a length of wire rope or an elastomeric pad, and in which the disk is adapted to be detachably secured to the end of the shaft by means of an end flange of said shaft and interengaging external and internal screw threads provided on the shaft and a fixing member, respectively, which is adapted to be tightened against the disk so as to force the latter against the flange, that object is accomplished in that the fixing member comprises an annular rib, which is formed with the internal screw threads, and a bowl, which is open toward the disk and is smaller in diameter than the disk, the shaft comprises a second rigid shaft section that is formed with second external screw threads, the flexible shaft section is disposed between said rigid shaft section and said flange, and a nut is screwed on said second external screw threads and bears on said bowl around said annular rib to force said bowl against said disk and thus to stiffen said shaft.

In a preferred embodiment said end flange is carried by a first rigid shaft section, said flexible shaft portion extends between said first rigid shaft section and a second rigid shaft section, which is formed with said second external screw threads, said first external screw threads cooperate with said internal screw threads of said fixing member to force said end flange of said shaft against said disk, and said nut is adapted to be tightened on said second external screw threads against said bowl for a transmission of torque from said second rigid shaft section via said nut and said bowl rather than by said flexible shaft section and said end flange.

In accordance with a further feature of the invention the disk carrying said buffing pad may be removed from said fixing member and may be replaced by a flat abrsive disk, which is adapted to be forced against said fixing member by said end flange and said bowl with an enlarged outer rim, which is adapted to be received by and to fit an annular groove formed in the rear surface of the disk. That arrangement permits a grinding with an abrasive tool having a smaller grinding surface.

DETAILED DESCRIPTION OF THE PREFERRED EMBODIMENTS

Further details of the abrasive tool for grinding or polishing in accordance with the invention will become apparent from the following description of two illustrative embodiments.

Figure 1:
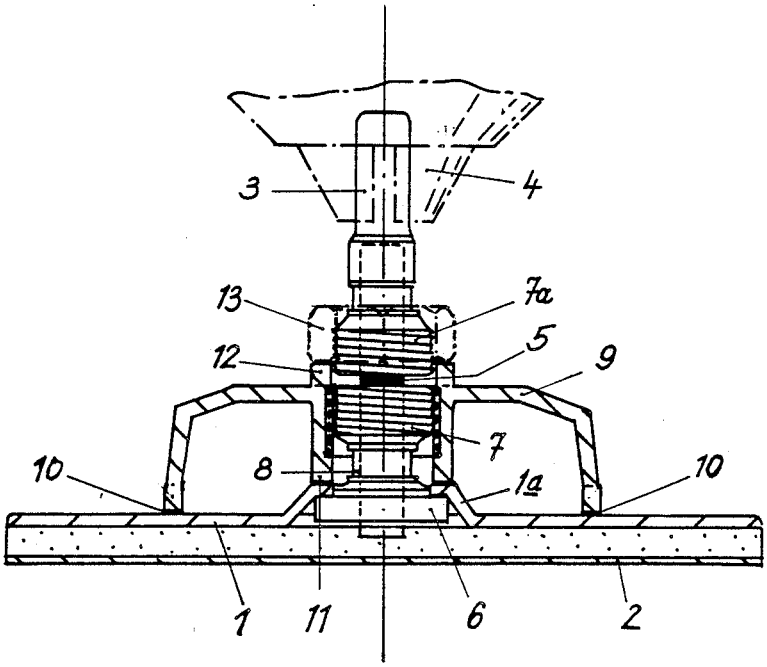
FIG. 1 is a central sectional view showing a buffing tool embodying the invention.

In the embodiment shown in FIG. 1 the abrasive tool for grinding or polishing comprises a disk 1, which carries on its front surface a buffing pad 2 consisting of an abrasive-containing woven fabric. The disk 1 is connected to a first portion of shaft 3, which is adapted to be gripped in a driving chuck 4 of a handheld drilling machine or a machine for use by hobbyists. The shaft 3 comprises a first rigid shaft portion 7, which extends through a central aperture of the disk 1. The shaft 3 terminates in an end flange 6 which is disposed in a ball portion 1*a* of the disk 1 and above the buffing pad 2.

The shaft 3 comprises a second shaft section 7*a* which is coupled to the second rigid shaft section 7 by a flexible shaft section 5, which may consist, e.g., of a piece of wire rope or of an elastomeric pad.

A fixing member comprising a bowl 9 is attachable to and secured to the disk 1 on its rear side, i.e., on the side that is opposite to the buffing pad 2. The bowl 9 has an outer rim 10, which is smaller in diameter than the disk 1 so that the latter has on its rear side an exposed annular surface around said bowl 9. The bowl 9 also comprises an annular rib 12 which is integral with the bowl 9 and which surrounds the flexible shaft section 5. The bowl 9 is provided with internal screw threads which interengage with the first external screw threads on the first rigid shaft portion 7 so that the bowl 9 can be tightened against the disk 1 to grip the disk 1 between the end flange 6 and an end flange 11 of the bowl 9.

The second rigid shaft section 7*a* is formed with a scond set of external screw threads, which interengage with the internal screw threads of a nut 13, which can be tightened against the annular rib 12 which is formed on the rear surface of the bowl 9. As a result, the second rigid shaft section 7*a* is directly connected by the nut 13 to the bowl 9 for a transmission of torque from the second rigid shaft section 7*a* to the disk 1 whereas the flexible shaft section 5 is relieved from torque.

Figure 2:
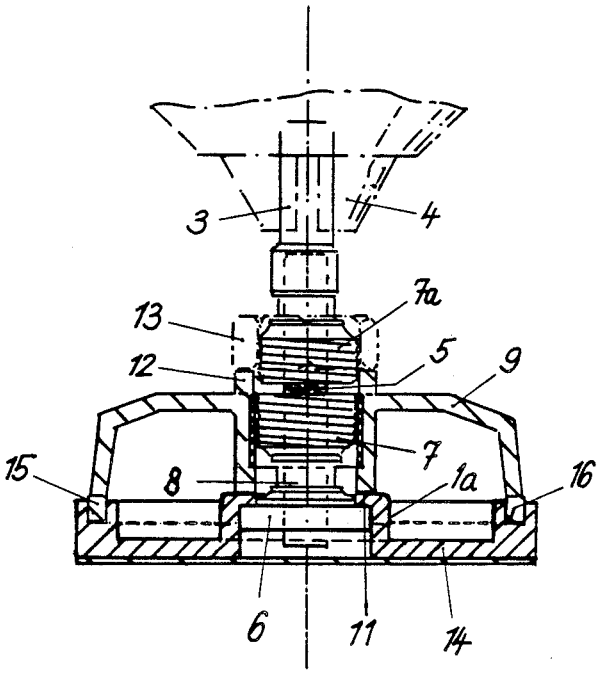
FIG. 2 is a central sectional view showing a grinding tool embodying the invention.

In the embodiment shown in FIG. 2, the disk 1 has been removed and replaced by a flat grinding disk 14, which is gripped between the end flange 6 and the end flange 11 of the annular rib, which are similar to those shown in FIG. 1. In the embodiment shown in FIG. 2, an outer rim 15 of the bowl 9 is received by an annular groove 16 formed on the rear surface of the grinding disk 14.

In both embodiments shown a disk 1 or 14 is provided, which has a central aperture and forward and rear surfaces. The grippable shaft 3 comprises first and second rigid shaft sections 7 and 7*a*, respectively, and the flexible shaft section 5 for transmitting torque between the first and second rigid shaft sections. The first rigid shaft section 7 extends through the central aperture of the disk and is formed with first external screw threads protruding behind said aperture. The flange 6 is detachably connected to the first rigid shaft section 7 in front of the disk 1. A hollow fixing member comprises the annular rib 12, which surrounds the shaft 3 on the rear of the disk 1 and is formed with internal screw threads interengaging with the first external screw threads on the first rigid shaft section 7 and is adapted to be tightened against said rear surface of said disk so that said disk is gripped between the flange and the annular rib. Stiffening means are provided, which are selectively operable to rigidly connect the rigid fixing member to the second rigid shaft section *7a* for a transmission of torque from the second rigid shaft section *7a* to the disk via said fixing member whereas the flexible shaft section is relieved from torque.

The fixing member also comprises a bowl 9, which is open toward the disk and has a rim 10, which is smaller in diameter than said disk and faces the rear surface of said disk. The second rigid shaft section *7a* has second external screw threads extending on the rear of said bowl 9.

The stiffening means comprise a stiffening nut 13, which has internal screw threads, which interengage with the second external screw threads of said second rigid shaft section *7a* on the rear of the bowl 9. The nut 13 is adapted to be tightened against the bowl 9 for a transmission of torque from the second rigid shaft section *7a* via the nut 13 and the bowl 9 to the disk 1 or 14 whereas the flexible shaft section 5 is relieved from torque.

Also in both embodiments, the nut 13 may be removed so that the annular rib 12 will then be able to contact the second rigid shaft section *7a* so as to limit the deflection of the flexible shaft section 5 to an extent that is determined by the radial clearance between the annular rib 12 and the adjacent portion of the second rigid shaft section *7a*, e.g., its screw threads.

We claim:

1. In an abrasive tool comprising a disk having a central aperture and forward and rear surfaces, a grippable shaft having first and second rigid shaft sections and a flexible shaft section connected between said first and second rigid shaft sections for a transmission of torque between them, said first rigid shaft section extending through said central aperture and being formed with first external screw threads behind said aperture, a flange detachably connected to said first rigid shaft section in front of said disk, a rigid fixing member, which comprises a sleeve, which surrounds said shaft on the rear of said disk and is formed with internal screw threads interengaging with said first external screw threads and is adapted to be tightened against said rear surface of said disk so that said disk is gripped between said flange and said sleeve, and stiffening means, which are selectively operable to rigidly connect said rigid fixing member to said second rigid shaft section for a transmission of torque from said second rigid shaft section to said disk via said fixing member whereas said flexible shaft section is relieved from torque, the improvement residing in that said fixing member comprises a bowl, which is open toward said disk and has a rim which is smaller in diameter than said disk and faces said rear surface of said disk, said bowl having at one end an annular rib and at another end an end flange, said second rigid shaft section has second external screw threads extending beyond the annular rib of said bowl, said stiffening means comprise a stiffening nut, which has internal screw threads, which interengage with said second external screw threads on the rear of said bowl and is adapted to be tightened against said annular rib of said bowl for a transmission of torque from said second rigid shaft section via said nut and said bowl to said disk whereby said flexible shaft section is relieved from torque.

2. The improvement set forth in claim 1, wherein said fixing member surrounds said second external screw threads with a radial clearance and said nut is adapted to be screwed on said second external screw threads to a position in which said nut clears said fixing means so that said fixing means are adapted to limit the deflection of said flexible shaft section by engaging said second external screw threads.

3. The improvement set forth in claim 1 as applied to an abrasive tool in which said disk carries on its forward surface a buffing pad consisting of an abrasive-containing woven fabric.

4. The improvement set forth in claim 1, wherein said disk consists of an abrasive disk.

5. The improvement set forth in claim 1, wherein said annular disk is formed on said rear surface with an annular groove, which is arranged to receive said rim of said bowl.

6. The improvement set forth in claim 5, wherein said rim is enlarged in thickness to fit said groove.

* * * * *